United States Patent [19]

Hagenbach

[11] 4,018,601

[45] Apr. 19, 1977

[54] ELECTROSTATOGRAPHIC MAGNETIC BRUSH IMAGING PROCESS EMPLOYING CARRIER BEADS COMPRISING HIGH PURITY NICKEL

[75] Inventor: Robert J. Hagenbach, Rochester, N.Y.

[73] Assignee: Xerox Corporation, Stamford, Conn.

[22] Filed: Nov. 18, 1971

[21] Appl. No.: 200,186

Related U.S. Application Data

[62] Division of Ser. No. 834,863, June 19, 1969, abandoned.

[52] U.S. Cl. ..... 96/1 SD; 252/62.1 P; 427/18; 427/19; 427/20

[51] Int. Cl.[2] ..... G03G 13/09; G03G 9/14

[58] Field of Search ..... 252/62.1; 117/17.5; 96/1 SD; 427/18, 19, 20

[56] References Cited

UNITED STATES PATENTS

| | | | |
|---|---|---|---|
| 2,890,963 | 6/1959 | Giaimo | 252/62.1 |
| 2,965,573 | 12/1960 | Gundlach | 252/62.1 |
| 3,054,751 | 9/1962 | Blake et al. | 252/62.5 |
| 3,093,039 | 6/1963 | Rheimfrank | 252/62.1 |
| 3,236,776 | 2/1966 | Tomanek | 252/62.1 |
| 3,278,439 | 10/1966 | Blanchette et al. | 252/62.1 |
| 3,320,169 | 5/1967 | East et al. | 252/62.1 P |
| 3,533,835 | 10/1970 | Hagenbach et al. | 252/62.1 P X |
| 3,545,968 | 12/1970 | Sato | 117/17.5 X |
| 3,547,822 | 12/1970 | Miller | 252/62.1 |
| 3,565,805 | 2/1971 | Jones | 252/62.1 |

FOREIGN PATENTS OR APPLICATIONS

| | | | |
|---|---|---|---|
| 43-7582 | 3/1968 | Japan | 96/1 SD |

OTHER PUBLICATIONS

English translation of Japanese Patent 43–7581, Mar. 22, 1968, to Matsushita Co.

*Primary Examiner*—J. Travis Brown
*Assistant Examiner*—John R. Miller

[57] ABSTRACT

Magnetic developer material comprising a carrier which comprises high purity nickel is disclosed. Electrophotographic processes employing said developer are also disclosed.

2 Claims, No Drawings

ELECTROSTATOGRAPHIC MAGNETIC BRUSH IMAGING PROCESS EMPLOYING CARRIER BEADS COMPRISING HIGH PURITY NICKEL

This is a division of application Ser. No. 834,863, now abandoned, filed in the U.S. on June 19, 1969.

BACKGROUND OF THE INVENTION

This invention relates in general to an imaging system and, more particularly, to an electrostatographic material.

Electrostatography is best exemplified by the process of xerography as first described in U.S. Pat. No. 2,297,691 to C. F. Carlson. In this process a photoconductor is first provided with a uniform electrostatic charge over its surface and is then exposed to an image of activating electromagnetic radiation which selectively dissipates the charge in illuminated areas of the photoconductor while the charge in the non-illuminated areas is retained thereby forming a latent electrostatic image. This latent electrostatic latent image is then developed or made visible by the deposition of finely-divided electroscopic marking particles referred to in the art as "toner." The toner will normally be attracted to those areas of the layer which retain a charge, thereby forming a toner image corresponding to the latent electroscopic image. This powdered image may then be transferred to a support surface such as paper. The transferred image may subsequently be permanently affixed to the support surface as by fusing. Instead of forming latent images by uniformly charging a photoconductive layer and the exposing the layer to a light and shadow image, an image may be formed by directly charging the layer or an insulating member in image configuration. The powder image may be fixed to the imaging layer if elimination of the powder image transfer step is desired. Other suitable means such as solvent or overcoating treatment may be substituted for the foregoing heat fixing steps.

Several methods are known for applying the electroscopic particles to the latent electrostatic image to be developed. One well-known commercial method for developing electrostatic images in the "cascade" process disclosed by L. E. Walkup in U.S. Pat. No. 2,618,551 and E. N. Wise in U.S. Pat. No. 2,618,552. In this method a developer material comprising relatively large carrier beads having fine toner particles electrostatically coated thereon is conveyed to or rolled or cascaded across the electrostatic image bearing surface. The composition of the carrier particles is so chosen as to triboelectrically charge the toner particles to the desired polarity. As the image cascades or rolls across the image bearing surface, the toner particles are electrostatically deposited and secured to the charged portion of a latent image and are not deposited on the uncharged or background portion of the image. Most of the toner particles accidentally deposited in the background areas are removed by the rolling carrier, due apparently to the greater electrostatic attraction between the toner and carrier than between the toner and the discharged background. The carrier and excess toner are then recycled.

In most commercial processes the cascade technique is carried out in automatic machines. In these machines small buckets on an endless belt conveyor scoop the developer mixture comprising relatively large carrier beads and smaller toner particles and convey it to a point above an electrostatic image bearing surface where the developer mixture is allowed to fall and roll by gravity across the image bearing surface. The carrier beads along with any unused toner particles are then returned to the sump for recycling through the developing system. Small quantities of toner material are periodically added to the developer mixture to compensate for the toner depleted during the development process. This process is repeated for each copy produced in the machine and is ordinarily repeated many thousands of times during the usable life of the developer mixture. It is apparent that in this process, as well as in other development techniques, the developer mixture is subjected to a great deal of mechanical attrition which tends to degrade both the toner and carrier particles. This degradation, of course, occurs primarily as a result of shear and impact forces due to the tumbling of the developer mixture on the image bearing plate and the movement of the bucket conveyor through the developer material in the sump.

Another method of developing electrostatic images is the "magnetic brush" process as disclosed, for example, in U.S. Pat. No. 2,874,063. In this method, a developer material containing toner and megnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

In prior art processes both coated and uncoated carrier beads were employed with degrees of success. Coated carrier beads are subject to deterioration or degradation characterized by the separation of portions of or the entire carrier coating from the carrier core. The separation may be in the form of chips, flakes, or entire layers and is primarily caused by poorly adhering coating materials which fail upon impact and abrasive contact with machine parts and other carrier particles. Carriers having coatings tend to chip and otherwise separate from the carrier core and must be frequently replaced, thereby increasing expense and consuming time. Print deletion and poor print quality occur when carrier particles having damaged coatings are not replaced. Fines and grit formed by the carrier coating disintegration tend to drift and form unwanted deposits on critical machine parts. In addition, the triboelectric properties of the carrier material varies with deterioration of the coating resulting in poor print quality.

Uncoated carrier beads on the other hand have three main deficiencies. First, often they lack the weight required to insure against adherence of the granular carrier material to the charged plate. Desirably, the specific gravity of the carrier material should be between about 3 and about 8.9. Heavier carrier bead materials cause impact damage to the surface of the image bearing layer. Secondly, the prior art uncoated carrier materials lacked the triboelectric qualities required of an electrostatographic material. Problems encountered when carrier materials lack these properties are set out in the following discussion. In the reproduction of high contrast copies such as letters, tracings and the like, it is desirable to select the electroscopic powder and carrier materials so that their mutual electrification is relatively large; the degree of such electrification being determined in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the latent electrostatic image and the toner particles. Although the image density described in the immediately preceding sentence may be improved by increasing the toner concentration in the developer mixture, undesirably high background toner deposition as well as increased toner impaction and agglomeration is encountered when the developer mixture is overtoned. The initial electrostatographic plate charge may be increased to improve the density of the deposited powdered image but the plate charge would ordinarilly have to be excessively high in order to attract the electroscopic powder away from the carrier particle. Excessively high electrostatographic plate charges are not only undesirable because of the high power consumption necessary to maintain the electrostatographic plate at high potentials but also because a high potential causes the carrier particles to adhere to the electrostatographic plate surface rather than merely roll across and off the electrostatographic plate surface. Print deletion and massive carryover of carrier particles often occur when carrier particles adhere to reusable electrostatographic imaging surfaces. Massive carrier carryover problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surfaces during image transfer and surface cleaning operations. It is, therefore, apparent that many material which otherwise have suitable properties for employment as carrier particles are unsuitable because they possess too high a triboelectric value. Desirably, the triboelectric value for conventional electrostatography measured in micro-coulombs per gram of toner should be between 8 and 30.

Finally, the triboelectric value of a carrier material should not be significantly affected by ambient humidity conditions since such affect would destroy print quality at higher humidities and complicate machine design and operation, many prior art uncoated materials were never commercially successful because of their great humidity sensitivity.

SUMMARY OF THE INVENTION

It is, therefore, an object of this invention to provide a system for developing electrostatic latent images which overcome the above noted deficiencies.

It is another object of this invention to provide a system for developing electrostatic latent images which is relatively insensitive to humidity conditions.

It is another object of this invention to provide a carrier material, which is relatively resistant to abrasion.

It is another object of this invention to provide a homogeneous carrier material which has relatively improved triboelectric properties.

It is another object of this invention to provide a homogeneous carrier material which has a relatively high density.

It is another further object of this invention to provide a homogeneous carrier material which has exceptional properties for use in a magnetic developer system.

The foregoing objects and others are accomplished in accordance with this invention, generally speaking, by providing a novel developer material comprising an uncoated carrier material which comprises high purity nickel.

While the nickel of this invention should be substantially highly pure best results are obtained when said nickel is over about 98% pure.

The uncoated carrier beads of this invention having a specific gravity of from about 8.0 to about 8.9 and produce high quality images over a wide range of ambient humidity conditions. Further, the bead does not require a coating to give it proper electrocals to perform as a carrier in xerographic machines. Moreover, this bead has the ability to maintain acceptable densities and background levels over wide toning ranges.

A carrier bead diameter of from about 30 microns to about 1,000 microns is usually preferred for electrostatographic use because the bead then possesses sufficient inertia to avoid adherence to the latent electrostatic images. When used in magnetic brush development systems it is preferred that said beads have a diameter of from about 50 microns to about 200 microns. Especially good results are obtained when said beads have a diameter of about 100 microns.

Any suitable pigmented or dyed electroscopic toner material may be employed with the uncoated carriers of this invention. Typical toner material include: gum copal; gum sandarac; rosin; cumaromeindene resin; asphaltum; uintaite; phenol formaldehyde resins; rosin modified phenol formaldehyde resins; methacrylic resins; polystyrene resins; polypropylene resins; epoxy resins; polyethylene resins and mixtures thereof. The particular toner material to be employed depends upon the separation of the toner particles from the treated carrier beads in the triboelectric series and whether a negatively or positively charged image is to be developed. Among the patents describing electroscopic toner compositions are U.S. Pat. No. 2,659,670 to Copley; U.S. Pat. No. 2,753,308, to Landrigan; U.S. Pat. No. 3,079,342 to Insalaco; U.S. Patent Re-issue 25,136 to Carlson, and U.S. Pat. No. 2,788,288 to Rheinfrank et. al. These toners generally have an average particle diameter between about 1 and 30 microns. A toner comprising a styrene-N-butyl methacrylate copolymer, polyvinylbutyral and carbon black produced by the method disclosed by M. A. Insalaco in Example I of U.S. Pat. No. 3,079,342 is preferred because of its excellent triboelectric qualities and its deep black color.

DESCRIPTION OF PREFERRED EMBODIMENTS

The following examples further specifically illustrate the present invention. The examples below are intended to illustrate the various preferred embodiments of the improved carrier materials. The parts and percentages are by weight unless otherwise indicated.

EXAMPLE I

A developer mixture is prepared by mixing one part of toner particles consisting of butyl methacrylate copolymer, polyvinylbutyral and carbon black, produced by the method disclosed in Example I of U.S. Pat. No. 3,079,342, having an average particle size of about 10 to about 20 microns, with about 100 parts uncoated magnetic carrier material comprising about 99.9% highly pure nickel. As described in U.S. Pat. No. 2,874,063, the toner-carrier mixture are carried by a magnet. The magnetic field of the magnet causes alignment of the carrier into a brush-like configuration. The "magnetic brush" is engaged with the electrostatic image-bearing surface and toner particles are drawn to the latent image by electrostatic attraction in each case. The resulting images are of excellent quality.

EXAMPLES II–III

Example I is repeated two successive times, except that in place of 99.9% nickel carrier material, 98.0 and 99.2% magnetic uncoated nickel carrier material is employed, respectively. In each case, the resulting images are of excellent quality.

EXAMPLES IV–V

Example I is repeated two successive times, except that in Example IV a cyan toner, tetra-(hexylsulfonamido) phthalocyanine is employed and in Example V a magenta toner, 1-amino-4-hydroxyanthraquinone, is used. In each case images of excellent quality are produced.

Although specific components and proportions have been stated in the above description of preferred embodiments of the invention, other typical materials as listed above where suitable may be used with similar results. In addition, other materials may be added to the mixture to synergize, enhance, or otherwise modify the properties of the carrier beads. For example, a material to improve the sphericity of the beads may be incorporated during manufacture.

The expressions developer and developing material as employed herein are intended to include electroscopic toner material or combinations of toner material and carrier material.

Other modifications and ramifications of the present invention will occur to those skilled in the art upon a reading of the disclosure. These are intended to be included within the scope of this invention.

What is claimed is:

1. An electrostatographic magnetic brush imaging process comprising the steps of forming an electrostatic latent image on a recording surface and developing said electrostatic latent image by contacting said electrostatic latent image with an electrostatographic developer mixture comprising finely-divided toner particles having an average particle diameter between about 1 micron and about 30 microns, said toner particles comprising tetra-(hexyl-sulfonamido) phthalocyanine, and carrier beads comprising uncoated, substantially spherical, magnetic particles consisting of at least about 98.0 percent by weight purity of nickel having an average particle diameter between about 50 microns and about 1000 microns, whereby at least a portion of said finely-divided toner particles are attracted to and held on said recording surface in conformance to said electrostatic latent image.

2. An electrostatographic magnetic brush imaging process comprising the steps of forming an electrostatic latent image on a recording surface and developing said electrostatic latent image by contacting said electrostatic latent image with an electrostatographic developer mixture comprising finely-divided toner particles having an average particle diameter between about 1 micron and about 30 microns, said toner particles comprising 1-amino-4-hydroxy-anthraquinone, and carrier beads comprising uncoated, substantially spherical, magnetic particles consisting of at least about 98.0 percent by weight purity of nickel having an average particle diameter between about 50 microns and about 1000 microns, whereby at least a portion of said finely-divided toner particles are attracted to and held on said recording surface in conformance to said electrostatic latent image.

* * * * *